US005785024A

United States Patent [19]

Takei et al.

[11] Patent Number: 5,785,024

[45] Date of Patent: Jul. 28, 1998

[54] CYLINDER HEAD DEVICE FOR INTERNAL COMBUSTION ENGINE

[75] Inventors: Nobuo Takei; Kenjiro Hatayama, both of Kyoto; Kazuyuki Nakazato, Okazaki; Eiji Kawazoe, Nagaokakyo, all of Japan

[73] Assignee: Mitsubishi Jidosha Kogyo Kabushiki Kaisha, Tokyo, Japan

[21] Appl. No.: 914,781

[22] Filed: Aug. 20, 1997

[30] Foreign Application Priority Data

Aug. 22, 1996 [JP] Japan ..... 8-221340

[51] Int. Cl.[6] ..... F02M 55/02

[52] U.S. Cl. ..... 123/470; 123/472

[58] Field of Search ..... 123/470, 509, 123/472, 468, 469, 471

[56] References Cited

U.S. PATENT DOCUMENTS

| | | | |
|---|---|---|---|
| 4,528,959 | 7/1985 | Hauser, Jr. . | |
| 5,121,731 | 6/1992 | Jones | 123/470 |
| 5,125,383 | 6/1992 | Meier | 123/470 |
| 5,247,918 | 9/1993 | Wakeman . | |
| 5,253,810 | 10/1993 | Maltby et al. . | |
| 5,630,400 | 5/1997 | Sumida | 123/470 |
| 5,694,898 | 12/1997 | Pontoppidan | 123/470 |
| 5,697,345 | 12/1997 | Genter | 123/470 |
| 5,706,786 | 1/1998 | Stephanus | 123/470 |
| 5,706,787 | 1/1998 | Fujikawa | 123/470 |

FOREIGN PATENT DOCUMENTS

| | | | |
|---|---|---|---|
| 0294586 | 12/1988 | European Pat. Off. | 123/470 |
| 2659115A1 | 9/1991 | France . | |
| 19616806A1 | 4/1997 | Germany . | |
| 58-35266 | 3/1983 | Japan | 123/470 |
| 0182681 | 8/1991 | Japan | 123/470 |
| 4005469 | 7/1992 | Japan | 123/470 |
| 6235366 | 8/1994 | Japan | 123/470 |
| 0687248 | 9/1976 | U.S.S.R. | 123/470 |
| 2066895A | 7/1981 | United Kingdom . | |

*Primary Examiner*—Carl S. Miller

[57] ABSTRACT

A cylinder head device for an internal combustion engine has a cylinder head with a mounting hole in which a fuel injector is inserted and a ring-shaped metal gasket. The mounting hole has an annular seat surface for supporting the fuel injector therein. The metal gasket is sandwiched between the fuel injector and the seat surface. The metal gasket includes a core and a coating layer for covering the entire surface of the core. The core has a contour approximately formed in the shape of a truncated cone in section, and also has inner and outer circumferential edges curved in an arc shape.

6 Claims, 7 Drawing Sheets

CYLINDER HEAD DEVICE FOR INTERNAL COMBUSTION ENGINE

BACKGROUND OF THE INVENTION

1. Field of the Invention

The present invention relates to a cylinder head device of for an internal combustion engine and more particularly relates to the cylinder head device for an internal combustion engine in which a fuel is directly injected to a combustion chamber.

2. Description of the Related Art

An engine of a spark ignition type for directly injecting a fuel from a fuel injector to a combustion chamber is known in an internal combustion engine. The engine of this kind has a mounting hole for the fuel injector in a cylinder head. The mounting hole is communicated with the combustion chamber of the engine and allows the fuel to be directly injected from the fuel injector to the combustion chamber.

In the case of the engine of this kind, a high temperature and a high pressure in the combustion chamber are applied to the gap between the fuel injector and an inner surface of the mounting hole so that the gap must be reliably sealed.

A flat ring-shaped metal gasket is generally used for sealing the gap. It is necessary to strongly fasten the fuel injector to the cylinder head, i.e., a seat face of the mounting hole through the metal gasket so as to sufficiently secure seal performance of the metal gasket.

Further, the fuel injector of the engine of this kind must be made compact and light in weight and an operation of this fuel injector is electronically controlled. Namely, the fuel injector has a low mechanical strength and a precise internal structure in comparison with a fuel injection valve of a diesel engine.

Therefore, when the fuel injector is pressed to the metal gasket to obtain sufficiently the seal performance of the metal gasket, the fuel injector is excessively fastened and a body and the internal structure thereof are distorted in a certain case. Thus, the fuel injector is inaccurately operated by this distortion so that the fuel injector can not inject the fuel with high precision.

The cylinder head is a cast product and the mounting hole of the fuel injector is formed in the cylinder head by drilling. Therefore, it is also considered that the seat face of the mounting hole is rough and a part of porosity in the cylinder head is exposed as pinholes on the seat face. The roughness of such a seat face and the pinholes reduce a close contact property between the metal gasket and the seat face of the mounting hole so that sufficient seal performance of the metal gasket can not be exhibited.

SUMMARY OF THE INVENTION

An object of the present invention is to provide a cylinder head device for an internal combustion engine capable of sufficiently securing the seal between a fuel injector and its mounting hole without providing an excessive fastening force to the fuel injector.

The above object has achieved by a cylinder head device for an internal combustion engine according to the present invention. The cylinder head device comprises a cylinder head including a mounting hole for inserting a fuel injector therein. The mounting hole communicates with a combustion chamber of the engine and has an annular stepped surface for supporting the fuel injector therein. The device further comprises seal means for sealing between the fuel injector and the annular stepped surface by pressing the fuel injector against the annular stepped surface. The seal means includes a ring-shaped seal member sandwiched between the fuel injector and the annular stepped surface. The seal member includes a metallic core being elastically deformable in an axial direction of the mounting hole, a ring-shaped first seal region projected convexly toward the fuel injector and a ring-shaped second seal region projected convexly toward the annular stepped surface. The seal means further includes elastic coating layers for covering the first and second seal regions.

According to the above cylinder head device, when the fuel injector is attached into the mounting hole, the fuel injector is pressed against the stepped surface of the mounting hole through the seal member. The core of the seal member is elastically deformed in the axial direction of the mounting hole by pressing the fuel injector so that a length or a height of the seal member in the axial direction of the mounting hole is shortened. Therefore, the first and second seal regions of the core are respectively pressed by restoring force of the core against the fuel injector and the stepped surface of the mounting through the coating layers, respectively.

The first and second seal regions of the core are formed in a convex ring shape toward the fuel injector and the stepped surface so that close contact areas of these seal regions are small. This means that the first and second seal regions are strongly pressed against the fuel injector and the stepped surface even when pressing force of the fuel injector, i.e., fastening force thereof is relatively weak.

The first and second seal regions of the core are covered with the elastic coating layers. Therefore, the first and second seal regions come into close contact with the fuel injector and the stepped surface through the coating layer, respectively, so that seal performance of the seal member is sufficiently exhibited.

This point will next be described in detail. Even when the stepped surface is rough and pinholes are exposed on a portion of the stepped surface corresponding to the second seal region, the roughness of the stepped surface and the pinholes thereon are reliably covered with the elastic coating layer. As a result, the roughness of the stepped surface and the pinholes do not reduce the seal performance of the seal member. Further, even if an outer surface or a seal surface of the fuel injector pressed against the first seal region of the core is damaged, this damage is also reliably covered with the elastic coating layer so that the seal performance of the seal member is not reduced.

The core of the seal member may have a contour formed in the shape of a truncated cone in longitudinal section. The first and second seal regions are formed at inner and outer circumferential edge portions of the core, respectively, by curving the inner and outer circumferential edge portions in directions opposed to each other. In this case, the core of the seal member can be elastically deformed as a disc spring.

The coating layer of the above second seal region may have a rubber layer on its outermost side. In this case, the coating layer of the second seal region has a more excellent elastic property so that the rough stepped surface, the pinholes and the damage of the fuel injector can be reliably covered with the coating layer.

An entire surface of the core of the seal member may be covered with the coating layer. In this case, the core is easily coated with the coating layer and the coating layer can protects the entire surface of the core.

The above seal means may further include a second coating layer for covering the stepped surface of the mounting hole. In this case, the rough stepped surface and the pinholes have no bad influence on the seal performance of the seal member.

The second coating layer is preferably formed by resin of an ultraviolet hardening type. In this case, the second coating layer is easily formed.

Further scope of applicability of the present invention will become apparent from the detailed description given hereinafter. However, it should be understood that the detailed description and specific example, while indicating preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompany drawings which are given by way of illustration only, and thus, are not limitative of the present invention, and wherein.

DETAILED DESCRIPTION OF THE PREFERRED EMBODIMENTS

Figure 1:
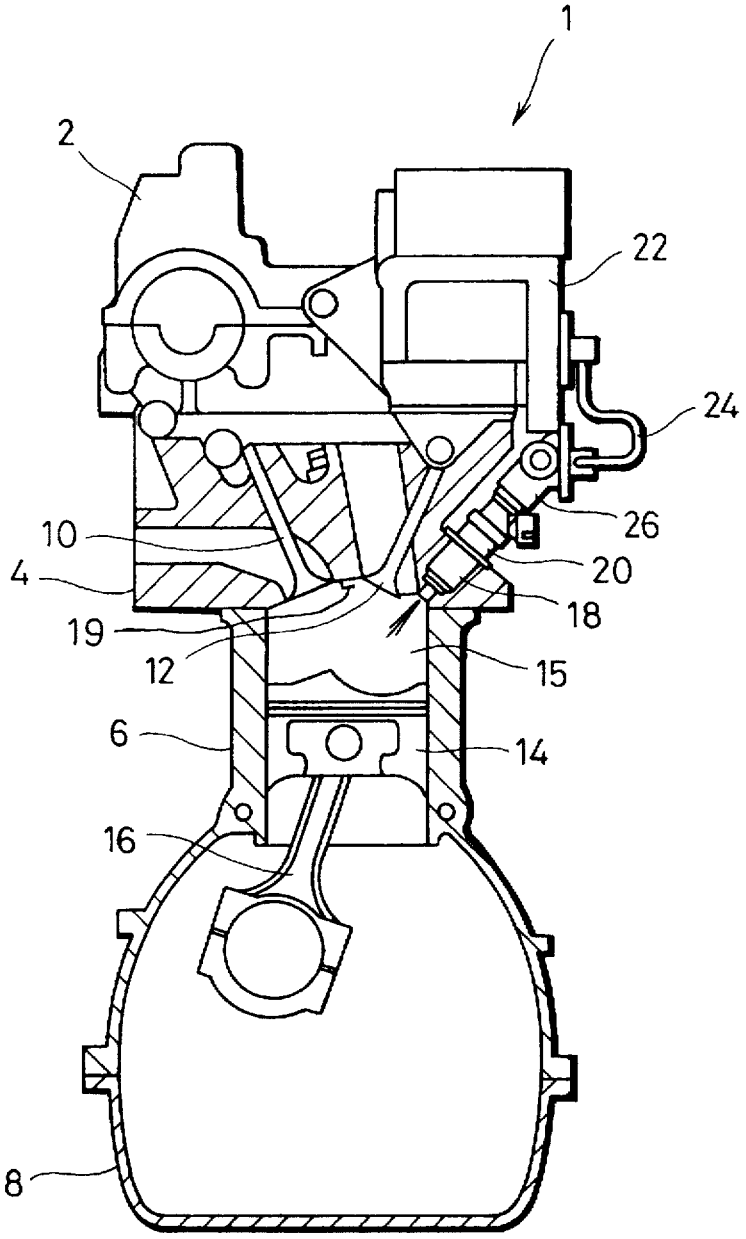
FIG. 1 is a schematic cross-sectional view of an engine.

With reference to FIG. 1, an engine 1 has a cylinder block 6 and a cylinder head 4 mounted onto an upper face of the cylinder block 6. A locker cover 2 is attached onto an upper face of the cylinder head 4. An oil pan 8 is attached onto a lower face of the cylinder block 6.

Exhaust valves 10 and intake valves 12 are arranged in the cylinder head 4. A cylinder bore 15 is defined in the cylinder block 6 and a piston 14 is fitted into the cylinder bore 15. The piston 14 is connected to a crankshaft through a connecting rod 16.

A stepped mounting hole 18 is formed in the cylinder head 4 and is communicated with the cylinder bore 15, i.e., a combustion chamber. A fuel injector 20 is inserted into the mounting hole 18. More particularly, a distal end of the fuel injector 20 faces the interior of the combustion chamber through a small diameter portion of the mounting hole 18. Therefore, the fuel injector 20 can directly inject a fuel, i.e., gasoline from a nozzle thereof into the combustion chamber. More particularly, different from a normal engine for injecting the gasoline into an intake port, the gasoline is directly injected into the cylinder of the engine 1. The injected fuel is mixed with the air in the combustion chamber and this mixture is ignited by a spark plug 19. The spark plug 19 is attached to the cylinder head 4 and is arranged between the exhaust valves 10 and the intake valves 12.

A proximal end of the fuel injector 20 is projected from the cylinder head 4 and is connected to a fuel distribution pipe 26. The fuel distribution pipe 26 is connected to a high-pressure fuel pump 22 through a fuel supply pipe 24. The high-pressure fuel pump 22 is attached onto the outer face of the cylinder head 4. The high-pressure fuel pump 22 pressurizes the fuel and supplies the pressurized fuel to the fuel injector 20 through the fuel supply pipe 24 and the fuel distribution pipe 26. A pressure of the fuel supplied to the fuel injector 20 is set to 5 to 7 MPa.

Figure 2:
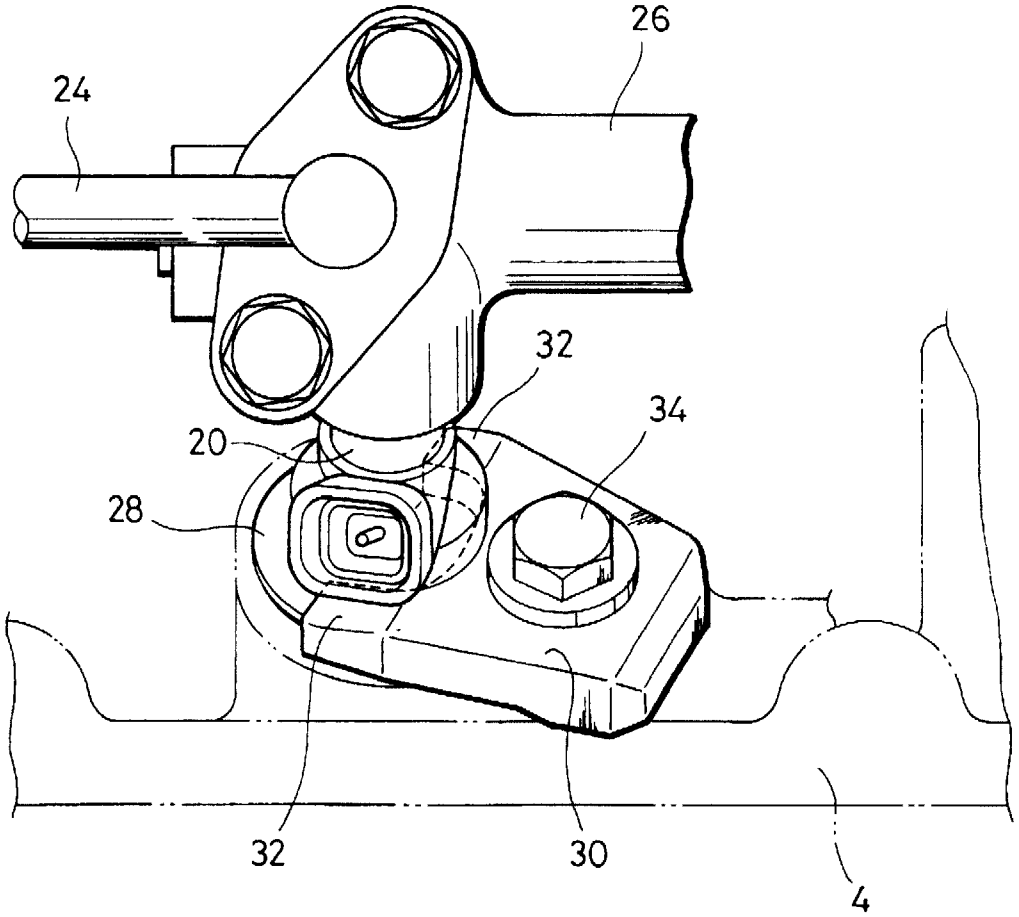
FIG. 2 is a perspective view showing a fastening holder for a fuel injector.

With reference to FIG. 2, the fuel injector 20 has a flange 28 located outside the cylinder head 4. The flange 28 is fixed to the outer face of the cylinder head 4 through a fastening holder 30. More particularly, the fastening holder 30 has a U-shaped notch at one end thereof. The notch forms a pair of pressing claws 32. An injector body of the fuel injector 20 is passed through the notch of the fastening holder 30. The pair of pressing claws 32 of the fastening holder 30 and an arc edge connecting these pressing claws 32 press the fuel injector 20 from above through the flange 28.

Another end portion of the fastening holder 30 is fixed to the outer face of the cylinder head 4 through a bolt 34 fastened with a predetermined fastening torque. In this case, the fastening force of the fuel injector 20, i.e., the bolt 34 is set to 200 kgf.

Figure 3:
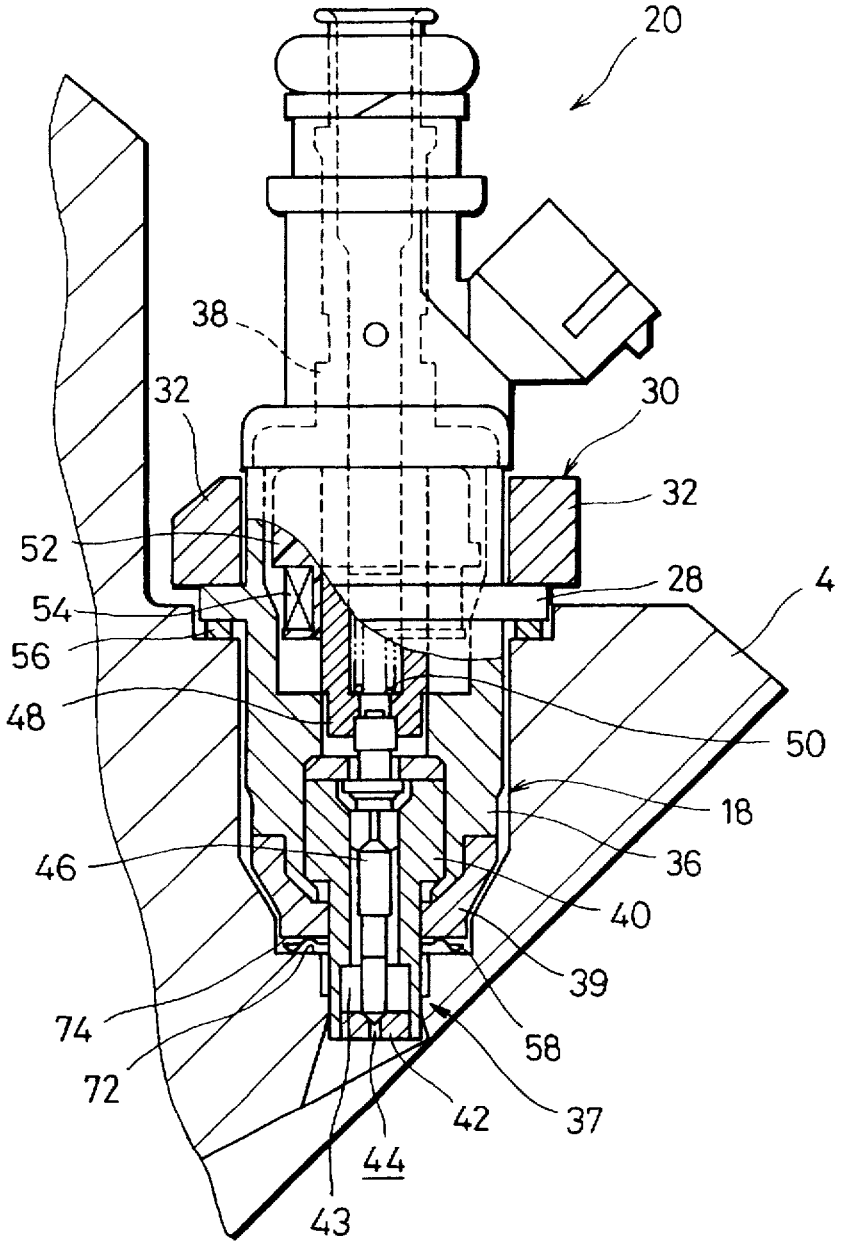
FIG. 3 is a view showing a mounting state of the fuel injector to a cylinder head.

With reference to FIG. 3, the relation between the flange 28 of the fuel injector 20 and the fastening holder i.e., the pair of pressing claws 32 can be more clearly understood.

As can be seen from FIG. 3, the distal end portion of the fuel injector 20 lower than its flange portion 28 is inserted into the above mounting hole 18.

The fuel injector 20 has an injector body 36 and the flange 28 is formed integrally with the injector body 36. The injector body 36 is formed in a stepped cylindrical shape. A hollow core member 38 is stored in the proximal end portion of the injector body 36 as shown in FIG. 3. The core member 38 extends in an axial direction of the injector body 36. An upper end of the core member 38 is projected from the injector body 36 and is connected to the above fuel distribution pipe 24. Accordingly, the fuel can be supplied from the fuel distribution pipe 24 to the core member 38.

A nozzle valve 37 of an electromagnetic operation type is assembled into the distal end portion of the injector body 36 through a retainer 39. The nozzle valve 37 has a nozzle body 40 projected from a lower face of the retainer 39. A projecting portion of the nozzle body 40 is inserted into the small diameter portion of the mounting hole 18, and a tip end thereof faces to the combustion chamber. The nozzle body 40 has a nozzle plug 42 at its tip end. The nozzle plug 42 defines a fuel chamber 43 in the nozzle body 40. The fuel chamber 43 is communicated with the above core member 38 through passages in the nozzle body 40 and the injector body 36. Accordingly, the fuel chamber 43 can be supplied with the fuel from the core member 38.

A nozzle hole 44 is formed in the nozzle plug 42. In a state shown in FIG. 3, a nozzle needle 46 closes the nozzle hole 44. The nozzle needle 46 extends from the fuel chamber 43 toward an upper end of the nozzle body 40 therein and is projected from the upper end. The nozzle needle 46 is arranged on an axial line of the nozzle body 40 and can be reciprocated in the axial direction of the nozzle body 40.

A hollow armature 48 is arranged in the injector body 36 and surrounds an upper portion of the nozzle needle 46, i.e., head portion thereof and is connected to the head portion. A compression coil spring 50 is arranged in the armature 48 and urges the nozzle needle 46 toward the plug 42, i.e., the valve seat for the nozzle hole 44 through the armature 48. Therefore, in the state shown in FIG. 3, the nozzle needle 46 closes the nozzle hole 42 by receiving the urging force of the compression coil spring 50. Further, a solenoid 54 wound around a bobbin 52 is arranged in the injector body 36 and surrounds the armature 48.

When the solenoid 54 is turned on, the armature 48, i.e., the nozzle needle 46 is lifted against the urging force of the compression coil spring 50 and opens the nozzle hole 44. At this time, the fuel is injected from the nozzle hole 44 into the combustion chamber 15.

While the engine 1 is operated, the interior of the combustion chamber 15 attains high temperature and high-pressure states. Therefore, a gap between the fuel injector 20 and the cylinder head 4 must be perfectly sealed. To this end, as shown in FIG. 3, a gasket 56 is arranged between the cylinder head 4 and the flange 28 of the fuel injector 20 and is made of copper. An annular stepped surface for supporting the retainer 39 of the fuel injector 20, i.e., a seat surface 72 is formed on an inner circumferential surface of the mounting hole 18. A elastically deformable metal gasket 58 is arranged between the seat surface 72 and the lower surface of the retainer 39. The lower surface of the retainer 39 is formed as a seat surface of the fuel injector 20 with respect to the metal gasket 58.

Figure 4:
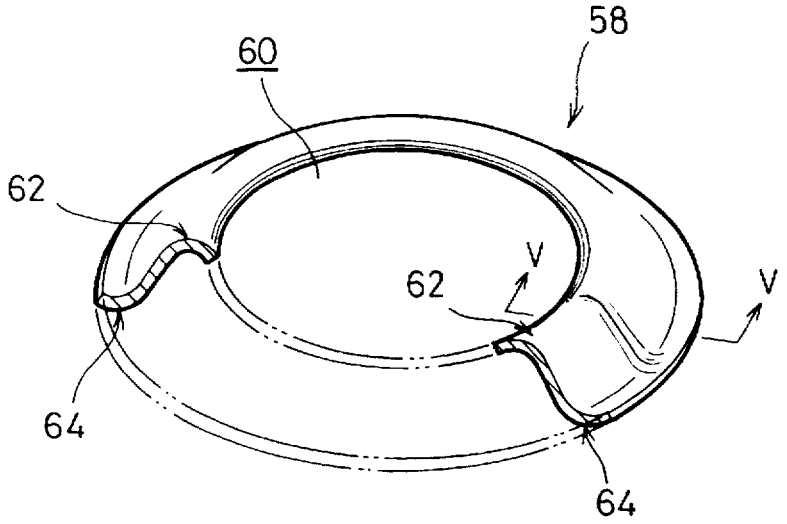
FIG. 4 is a perspective view of a metal gasket removing a coating layer therefrom.

As shown in FIG. 4, the metal gasket 58 is formed in a ring shape. A portion from the inner circumferential edge of the metal gasket 58 to the outer circumferential edges thereof is formed in the shape of a character S in view of the sectional plan of the metal gasket 58. Namely, the inner circumferential edge portion of the metal gasket 58 is curved such that the inner circumferential edge portion is projected upward in FIG. 4. The outer circumferential edge portion of the metal gasket 58 is curved such that the outer circumferential edge portion is projected downward. Therefore, the inner and outer circumferential edges of the metal gasket 58 are not located on the same plane so that the metal gasket 58 has a predetermined thickness. The outer circumferential edge of the metal gasket 58 has a diameter approximately equal to that of the retainer 39. The tip end of the nozzle body 40 can be inserted into the metal gasket 58, i.e., a central hole 60 of the metal gasket 58.

The inner and outer circumferential edge portions of the metal gasket 58 respectively have a ring-shaped upper seal region 62 and a ring-shaped lower seal region 64. These seal regions 62 and 64 are located in vertexes of the inner and outer circumferential edge portions of the metal gasket 58 having an arc shape in section. When the metal gasket 58 is in a free state, the distance between the upper seal region 62 and the lower seal region 64, that is, the initial set length of the metal gasket 58 is set to about 1.6 mm, for example. Therefore, as can be seen from FIG. 4, the contour of the metal gasket 58 is approximately formed in a trapezoidal shape.

As shown in FIG. 3, when the metal gasket 58 is sandwiched between the retainer 39 and the seat surface 72 of the mounting hole 18 with a predetermined fastening force, the metal gasket 58 is elastically deformed and is compressed in the axial direction of the mounting hole 18. Thus, the upper seal region 62 is pressed against the lower surface 74 of the retainer 39 and the lower seal region 64 is pressed against the seat surface 72 of the mounting hole 18 by the restoring force of the metal gasket 58.

Figure 5:
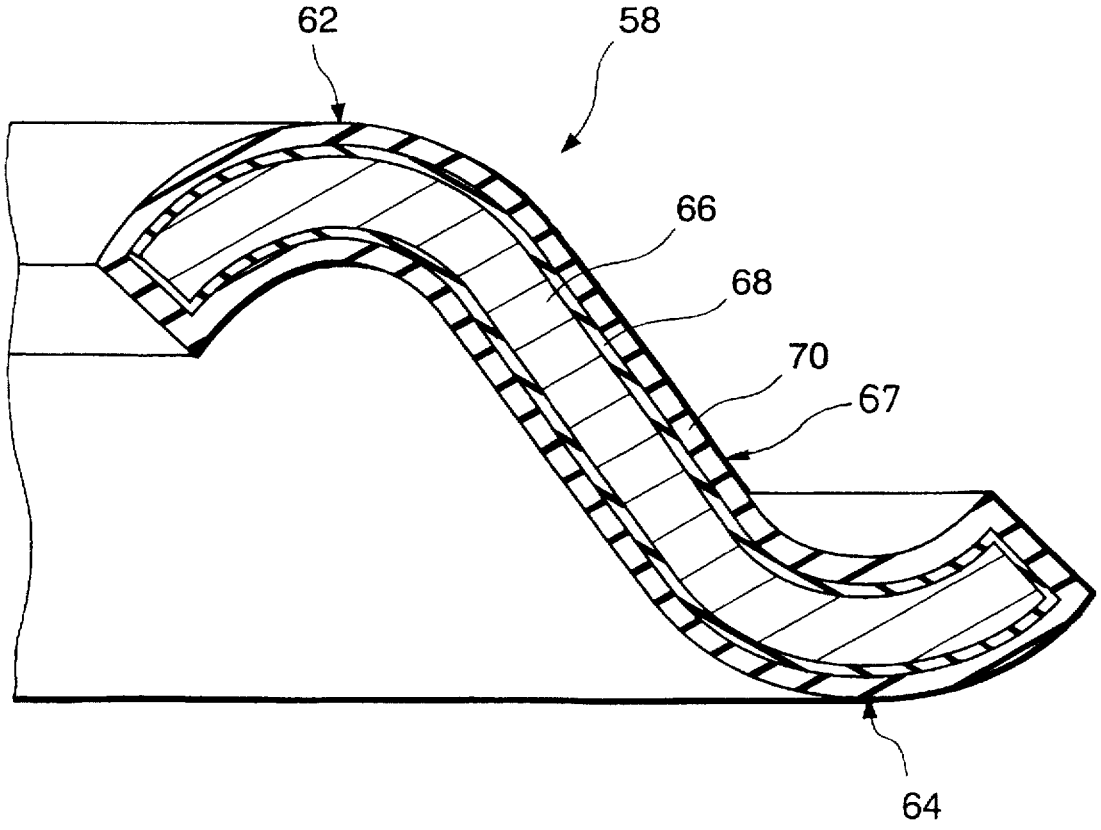
FIG. 5 is a cross-sectional view taken along line V—V in FIG. 4.

FIG. 5 shows a part of the above metal gasket 58 in an enlarged section. As can be seen from FIG. 5, the metal gasket 58 includes a core 66 and a coating layer 67 formed on the surface of the core 66. For example, the core 69 is made of stainless steel and has about 0.5 mm in thickness. The coating layer 67 is constructed by a two-layer structure in which the coating layer 67 has a primer, i.e., a first layer 68 directly formed on the surface of the core 66 and a second layer 70 formed on the outer surface of the first layer 68. For example, the first layer 68 is made of silicone resin and has 2 to 3 μm in thickness. The second layer 70 is made of fluoro rubber and has 15 to 45 μm in thickness. The second layer 70 is easily adhered to the core 66 by the existence of the first layer 68 so that the second layer 70 is strongly adhered to the core 66 through the first layer 68.

The entire surface of the core 66 is not necessarily covered with the coating layer 67. Only the upper and lower seal regions 62 and 64 and portions near these regions may be covered with coating layers similar to the coating layer 67.

Figure 6:
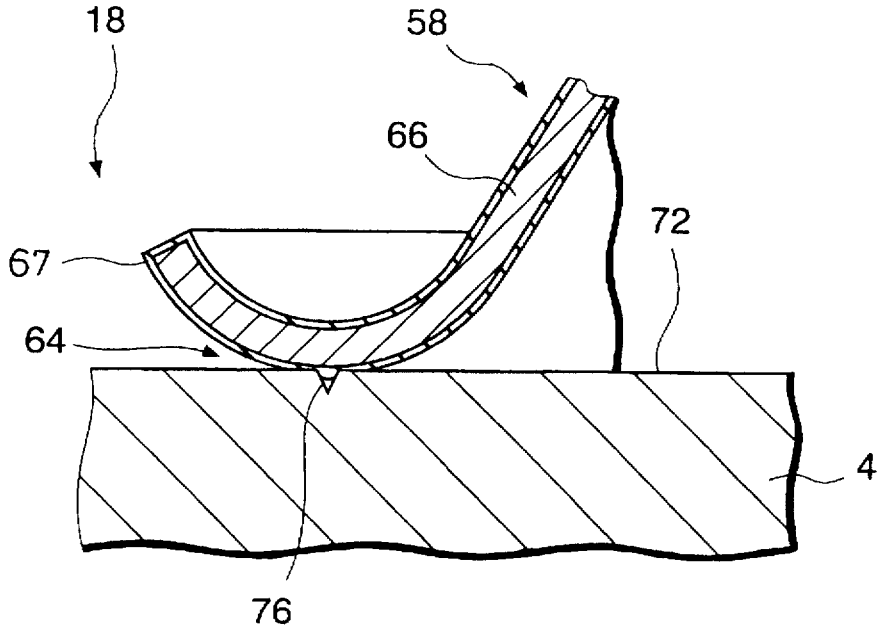
FIG. 6 is a view showing a close contact state between a seat face of a mounting hole and the metal gasket.

FIG. 6 shows a state in which the lower seal region 64 of the metal gasket 58 is pressed against the seat surface 72 of the mounting hole 18. Even if the seat surface 72 of the mounting hole 18 is rough and pinholes 76 are exposed to the seat surface 72, the rough seat surface 72 and the pinholes 76 are preferably covered with the coating layer 67 of the lower seal region 64 as shown in FIG. 6. Accordingly, the lower seal region 64 can preferably come in close contact with the seat surface 72 through the coating layer 67.

Here, the pinholes 76 are exposed part of porosity in the cylinder head 4 on the seat surface 72 by drilling of the mounting hole 18, or are generated on the seat surface 72 at a heat treatment of the cylinder head 4.

Figure 7:
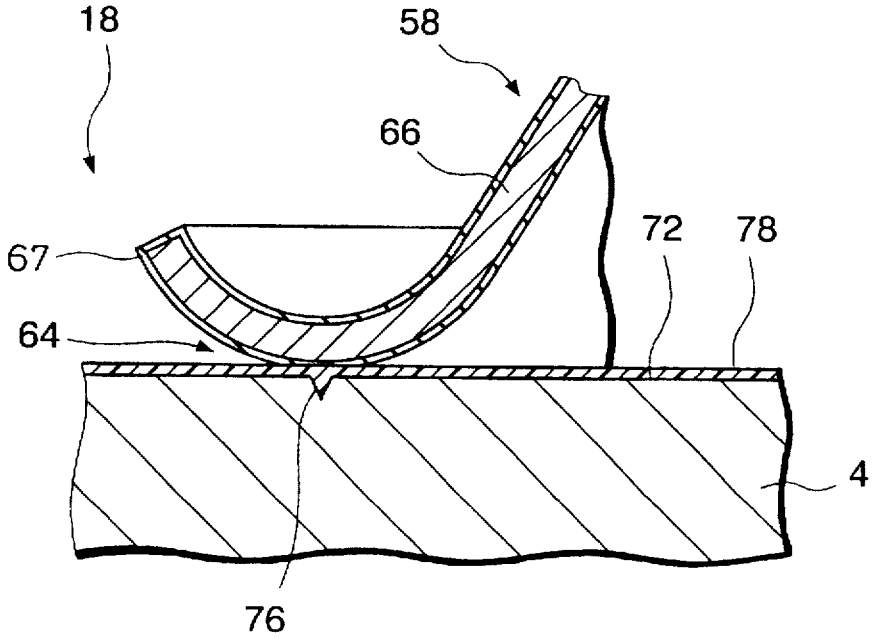
FIG. 7 is a view showing a coating layer formed on the seat face of the mounting hole.

As shown in FIG. 7, the seat surface 72 can be also covered with a coating layer 78. For example, the coating layer 78 is made of an ultraviolet hardening type resin and covers the rough seat surface 72 and the pinholes 76. In this case, the lower seal region 4 of the metal gasket 58 comes in contact with the seat surface of the mounting hole 18 through the coating layers 67 and 78.

As mentioned above, the core 66 of the metal gasket 58 is made of stainless steel and the contour thereof is approximately formed in a trapezoidal shape. Therefore, when the metal gasket 58 is sandwiched between the lower surface of the retainer 39 and the seat surface 72 of the mounting hole 18, the metal gasket 58 is elastically deformed as a disc spring.

Figure 8:
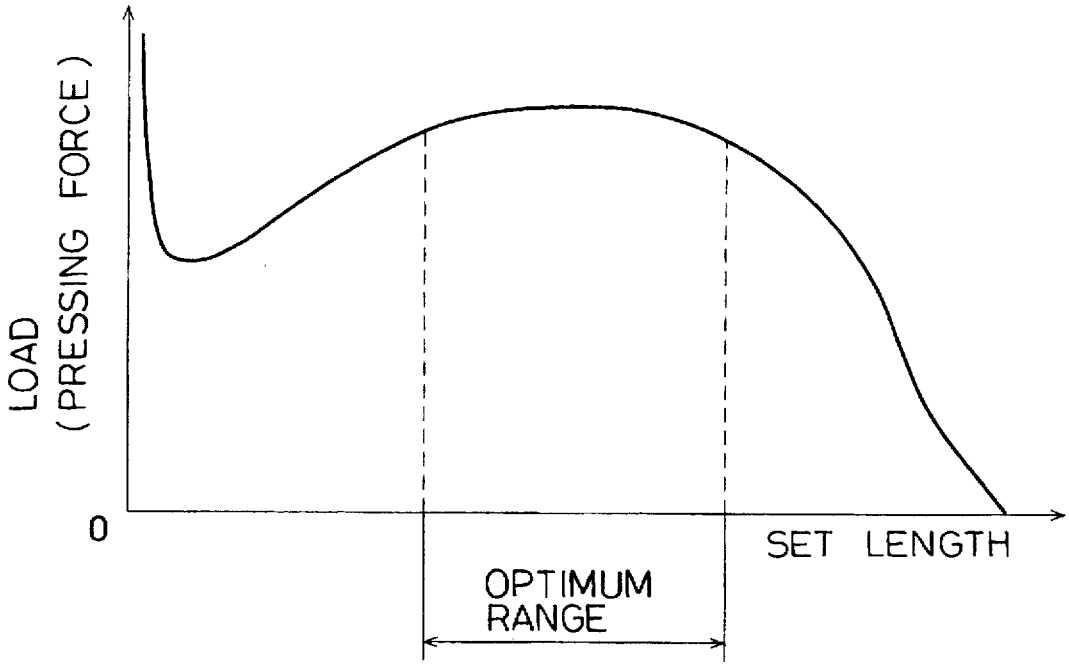
FIG. 8 is a graph showing the relation between a set length and a load of the metal gasket of FIG. 5.

FIG. 8 shows the relation between the set length of the metal gasket 58, i.e., the distance between the upper and lower seal regions 62 and 64, and the load (pressing force) applied to the metal gasket 58 from the lower face 74 of the retainer 39 and the seat surface 72 of the mounting hole 18 at the upper and lower seal regions 62 and 64. When no load is applied to the metal gasket 58, the metal gasket 58 has the above-mentioned initial set length. As can be seen from FIG. 8, the load of the metal gasket 58 is gradually increased as the set length of the metal gasket 58 is reduced. However, when the set length of the metal gasket 58 exceeds a predetermined value and is further reduced, the load of the metal gasket 58 begins to be gradually reduced. When the set length of the metal gasket 58 is further reduced, the load of the metal gasket 58 is rapidly increased. This shows that the metal gasket 58 is broken.

As mentioned above, the load of the metal gasket 58 has nonlinear characteristics with respect to its set length. Therefore, the set length of the metal gasket 58 is preferably set in the vicinity of the above predetermined value providing a maximum load, i.e., within an optimum range shown in FIG. 8. Here, the set length of the metal gasket 58 is adjusted by fastening torque of the bolt 34 of the above fastening holder 30. When the set length of the metal gasket 58 is set, tolerance with respect to processing and assembly of parts is naturally considered.

As mentioned above, since the upper and lower seal regions 62 and 64 of the metal gasket 58 are narrow, these seal regions 62 and 64 are pressed against the seat surface 72 of the mounting hole 18 and the lower surface of the retainer 39 with the strong force even when fastening force of the fuel injector 20, i.e., the metal gasket 58 is weak. As a result, the upper and lower seal regions 62 and 64 of the metal gasket 58 exhibit large seal performance.

The seat surface 72 of the mounting hole 18 is covered with the coating layer 67. Therefore, even if the seat surface 72 is rough and has the pinholes 76, the coating layer 67 preferably comes in close contact with the seat surface 72 irrespective of the roughness of the seat surface 72 and the pinholes 76. Accordingly, the seal performance of the lower seal region 64 is not reduced.

As mentioned before, if the seat surface 72 of the mounting hole 18 is covered with the coating layer 78, the seal performance of the lower seal region 64 can be further improved.

With respect to the coating layer 67, the second layer 70 is adhered to the core 66 of the metal gasket 58 through the first layer 68 made of silicone resin. Accordingly, the adhesion of the second layer 70 is strengthened so that the second layer 70 is not separated from the core 66. The second layer 70 is made of fluoro rubber having excellent durability. Therefore, the second layer 70 is not easily deteriorated even when the interior of the combustion chamber of the gasoline engine, in which the gasoline is directly injected into the combustion chamber, becomes high in pressure and temperature. Accordingly, the seal performance of the metal gasket 58 can be maintained for a long period.

Further, as shown in FIG. 8, an optimum range to the set length of the metal gasket 58 is wide so that the metal gasket 58 is easily set.

Figure 9:
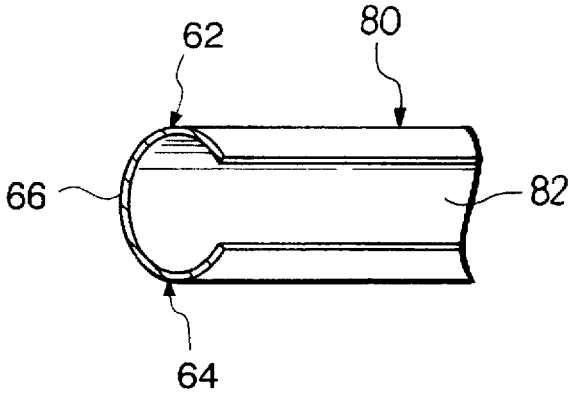
FIG. 9 is a view showing a metal gasket in a second embodiment.

FIG. 9 shows a metal gasket 80 in a second embodiment. The metal gasket 80 is formed in a hollow ring shape and has a slit 84. The slit 84 extends along an inner circumferential side of the metal gasket 80 so that the metal gasket 80 has a C-shape in section. In this case, upper and lower seal regions 62 and 64 of the metal gasket 80 are formed in arc shapes reverse to each other in section.

Figure 10:
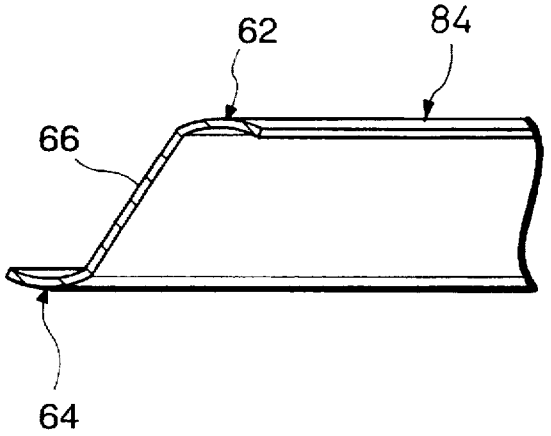
FIG. 10 is a view showing a metal gasket in a third embodiment.

FIG. 10 shows a metal gasket 84 in a third embodiment. The metal gasket 84 has a shape similar to that of the metal gasket 58 in the first embodiment. However, the metal gasket 84 differs from the metal gasket 58 in that a portion between the upper seal region 62 and the lower seal region 64 is linearly formed in section.

Figure 11:
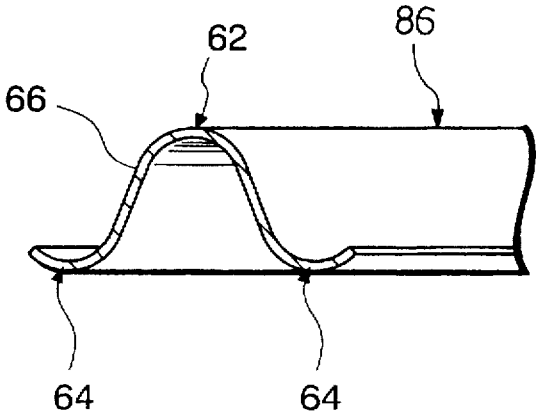
FIG. 11 is a view showing a metal gasket in a fourth embodiment.

FIG. 11 shows a metal gasket 86 in a fourth embodiment. The metal gasket 86 is formed in a downward directed U-shape in section and both end portions of the metal gasket 86 are respectively formed as a lower seal region 64.

Each of surfaces of the metal gaskets 80, 84, 86 in the second to fourth embodiments is covered with the above-mentioned coating layer 67 although these covering structures are not illustrated.

What is claimed is:

1. A cylinder head device for an internal combustion engine including a fuel injector for directly injecting a fuel into a combustion chamber, said cylinder head device comprising:

a cylinder head including a mounting hole for receiving said fuel injector and communicated with the combustion chamber, the mounting hole having an annular stepped surface for supporting the said injector therein; and seal means for sealing a gap between said fuel injector and the stepped surface of said mounting hole by pressing said fuel injector in said mounting hole against the stepped surface, said seal means including a ring-shaped seal member sandwiched between said fuel injector and the stepped face, said seal member having a metallic core elastically deformable in an axial direction of said mounting hole, a ring-shaped first seal region projected convexly toward said fuel injector and a ring-shaped second seal region projected convexly toward the stepped face, and elastic coating layers for covering the first and second seal regions.

2. The device according to claim 1, wherein the core further has a contour formed in the shape of a truncated cone in section, and inner and outer circumferential edge portions curved in directions reverse to each other and respectively forming the first and second seal regions.

3. The device according to claim 2, wherein said coating layers includes a rubber layer on an outermost side thereof.

4. The device according to claim 3, wherein an entire surface of the core is covered with the same coating layer to said coating layers.

5. The cylinder head device according to claim 2, wherein said seal means further includes a second coating layer for covering the stepped surface of said mounting hole.

6. The device according to claim 2, wherein said seal means further includes a second coating layer made of an ultraviolet hardening type resin for covering the stepped surface of said mounting hole.

* * * * *